US010867550B2

(12) United States Patent
Hwangbo

(10) Patent No.: US 10,867,550 B2
(45) Date of Patent: Dec. 15, 2020

(54) ORGANIC LIGHT EMITTING DIODE DISPLAY DEVICE

(71) Applicant: LG ELECTRONICS INC., Seoul (KR)

(72) Inventor: Hanseok Hwangbo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/141,804

(22) Filed: Sep. 25, 2018

(65) Prior Publication Data

US 2019/0096320 A1 Mar. 28, 2019

Related U.S. Application Data

(60) Provisional application No. 62/562,499, filed on Sep. 25, 2017.

(30) Foreign Application Priority Data

Oct. 30, 2017 (KR) ..... 10-2017-0142738

(51) Int. Cl.
*G09G 3/3208* (2016.01)

(52) U.S. Cl.
CPC ... *G09G 3/3208* (2013.01); *G09G 2310/0245* (2013.01); *G09G 2320/0257* (2013.01); *G09G 2320/041* (2013.01); *G09G 2330/02* (2013.01); *G09G 2330/027* (2013.01)

(58) Field of Classification Search
None
See application file for complete search history.

(56) References Cited

U.S. PATENT DOCUMENTS

2008/0218451 A1 9/2008 Miyamoto et al.
2008/0258695 A1* 10/2008 Kumar ..... H05B 33/0818 323/223
2014/0092144 A1* 4/2014 Kim ..... G09G 3/3233 345/690
2016/0018755 A1* 1/2016 Obayashi ..... G03G 15/04054 347/118
2016/0069947 A1* 3/2016 Wang ..... G09G 3/006 324/762.07
2016/0189624 A1* 6/2016 Jang ..... G09G 3/3258 345/213
2017/0249063 A1* 8/2017 Yu ..... G06F 3/0484
2018/0277041 A1 9/2018 Jang et al.

FOREIGN PATENT DOCUMENTS

EP 3038085 6/2016

OTHER PUBLICATIONS

European Patent Office Application Serial No. 18196456.0, Search Report dated Nov. 23, 2018, 10 pages.

* cited by examiner

*Primary Examiner* — Parul H Gupta
(74) *Attorney, Agent, or Firm* — Lee, Hong, Degerman, Kang & Waimey

(57) ABSTRACT

An organic light emitting diode display apparatus includes a display panel, a discharge circuit configured to discharge a voltage if the display panel is driven for more than a predetermined time and the supply of power to the display panel is interrupted, and a processor configured to, if the power is supplied, determine whether a cooling time required for afterimage compensation of the display panel is satisfied, and if the cooling time is satisfied, perform the afterimage compensation of the display panel.

13 Claims, 16 Drawing Sheets

ORGANIC LIGHT EMITTING DIODE DISPLAY DEVICE

CROSS-REFERENCE TO RELATED APPLICATIONS

Pursuant to 35 U.S.C. § 119, this application claims the benefit of earlier filing date and right of priority of U.S. Provisional Patent Application No. 62/562,499, filed on Sep. 25, 2017, and also claims the benefit of Korean Patent Application No. 10-2017-0142738, filed on Oct. 30, 2017, the contents of which are all incorporated by reference herein in their entirety.

BACKGROUND

The present disclosure relates to an organic light emitting diode (OLED) display apparatus, and more particularly, to an OLED display apparatus capable of measuring an off time of a display panel even if the supply of power is interrupted.

Recently, various types of display apparatuses have appeared. Among them, an organic light emitting diode (OLED) display apparatus is widely used. Since the OLED display apparatus is a self-luminous apparatus, the OLED display apparatus has lower power consumption and can be made thinner than a liquid crystal display (LCD) requiring a backlight. In addition, the OLED display apparatus has a wide viewing angle and a fast response time.

A general OLED display apparatus includes red (R), green (G), and blue (B) sub-pixels as one unit pixel and display one image having various colors through the three sub-pixels.

In the case of the OLED display apparatus, if a fixed image (for example, an advertisement image of a store) is displayed for a long time, the corresponding light emitting devices also emit light continuously. If a current continuously flows through a specific light emitting device for a long time, the corresponding light emitting device may be overloaded and thus the lifespan of the corresponding light emitting device may be shortened.

As a result, the color representation capability of the corresponding light emitting device is degraded. Thus, if an image on a screen is changed, there occurs a burn-in phenomenon in which a screen is not displayed clearly as if an afterimage of a previous image remains or a screen is stained.

An afterimage compensation method is used for solving the problem that an afterimage of a previous image remains on a screen.

The afterimage compensation method compensates for brightness reduced by deterioration of pixels, and requires a cooling time which is a time for turning off a display panel for a predetermined time. If a cooling time is not ensured for a sufficient time, the temperature of the display panel increases, and thus a voltage is excessively sensed. Thus, the accuracy of afterimage compensation may be reduced.

If AC power is off, the processor of the OLED display apparatus cannot measure the cooling time. Thus, if AC power is turned on after the AC power is turned off, the screen may be turned off so as to secure the cooling time of the display panel.

In this case, a user cannot use the display panel for a predetermined time because the screen is turned off. In particular, in a case where the display panel must be immediately used for promotion, just like TVs displayed in stores, store users may suffer great inconvenience because the screen is turned off so as to secure the cooling time.

Meanwhile, a battery and a real time check (RTC) circuit have been used for measuring the cooling time. However, the configuration of the battery and the RTC circuit is expensive, and the use of the battery is not permanent.

SUMMARY

Embodiments provide an organic light emitting diode (OLED) display apparatus capable of measuring a cooling time of a display panel even if the supply of power is interrupted.

Embodiments provides an OLED display apparatus capable of measuring a cooling time of a display panel by using a switch element and a capacitor, even if the supply of power is interrupted, without expensive battery or RTC circuit.

In one embodiment, an OLED display apparatus includes: a display panel; a discharge circuit configured to discharge a voltage if the display panel is driven for more than a predetermined time and the supply of power to the display panel is interrupted; and a processor configured to, if the power is supplied, determine whether a cooling time required for afterimage compensation of the display panel is satisfied, and if the cooling time is satisfied, perform the afterimage compensation of the display panel.

According to various embodiments of the present disclosure, if the supply of power is interrupted, the cooling time of the display panel can be measured. Thus, it is unnecessary to turn off the screen so as to secure the cooling time in a state in which the power is on. Therefore, the afterimage compensation can be quickly performed.

According to various embodiments of the present disclosure, if the supply of power is interrupted, the cooling time of the display panel can be measured by using an inexpensive discharge circuit, thereby achieving cost reduction.

The details of one or more embodiments are set forth in the accompanying drawings and the description below. Other features will be apparent from the description and drawings, and from the claims.

DETAILED DESCRIPTION OF THE EMBODIMENTS

Examples of various embodiments are illustrated in the accompanying drawings and described further below. The suffixes "module" and "unit" for components used in the description below are assigned or mixed in consideration of easiness in writing the specification and do not have distinctive meanings or roles by themselves.

A display apparatus according to an embodiment of the present disclosure is, for example, an intelligent display apparatus in which a computer support function is added to a broadcast reception function. An Internet function or the like is added to the display apparatus that fundamentally has the broadcast reception function. Accordingly, the display apparatus may include an easy-to-use interface, such as a writing input device, a touch screen, or a spatial remote control device. With the support of a wired or wireless Internet function, the display apparatus device may connect to the Internet and computers and perform functions such as e-mail, web browsing, banking, or games. In order to perform such various functions, standardized general-purpose OS may be used.

Accordingly, since various applications are freely added or deleted on a general purpose OS kernel, a display apparatus described herein may perform various user-friendly functions.

Figure 1:
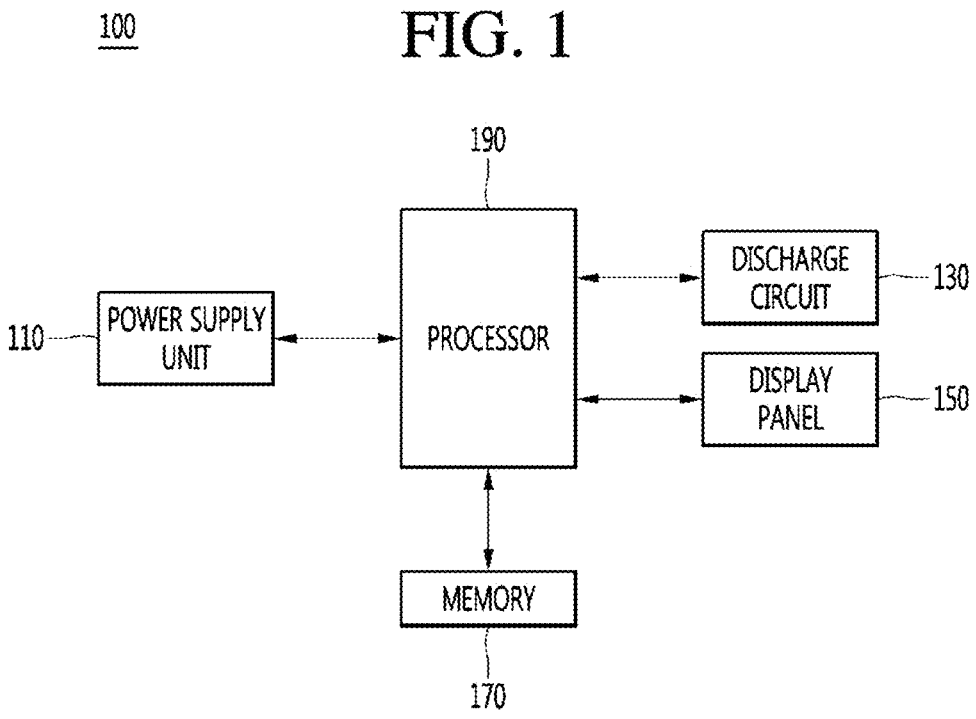
FIG. 1 is a block diagram illustrating a configuration of an OLED display apparatus according to an embodiment of the present disclosure.

FIG. 1 is a block diagram illustrating a configuration of an organic light emitting diode (OLED) display apparatus according to an embodiment of the present disclosure.

Referring to FIG. 1, the OLED display apparatus 100 according to an embodiment of the present disclosure may include a power supply unit 110, a discharge circuit 130, a display panel 150, a memory 170, and a processor 190.

The power supply unit 110 may supply DC power or AC power to the OLED display apparatus 100.

If AC power is supplied to the OLED display apparatus 100 and DC power is not supplied thereto, the display panel 150 is in a standby state. From the viewpoint of the practical use, this may be a case where a user turns off the power of the display panel 150 through a remote controller and does not unplug an outlet.

If AC power is not supplied to the OLED display apparatus 100, the display panel 150 is in an off state. From the viewpoint of the practical use, this may be a case where a user unplugs an outlet.

The discharge circuit 130 may measure a cooling time necessary for afterimage compensation of the display panel 150.

If the supply of power is interrupted, the discharge circuit 130 may measure a discharge voltage amount of a capacitor.

The processor 190 may determine whether the cooling time during which the display panel 150 can be sufficiently cooled is secured by using the measured discharge voltage amount.

The display panel 150 may display an image.

The display panel 150 may be an OLED panel.

The display panel 150 may include a plurality of sub-pixels (SP). The plurality of sub-pixels may be formed in pixel regions defined by a plurality of gate lines and a plurality of data lines intersecting with one another.

A plurality of driving power lines are formed on the display panel 150. The plurality of driving power lines are formed in parallel to the plurality of data lines and supply driving power.

Each of the plurality of sub-pixels may be one of a red sub-pixel, a green sub-pixel, a blue sub-pixel, and a white sub-pixel.

One unit pixel which displays one image may include a red sub-pixel, a green sub-pixel, a blue sub-pixel, and a white sub-pixel adjacent to one another, or may include a red sub-pixel, a green sub-pixel, and a blue sub-pixel.

Each of the plurality of sub-pixels may include an OLED and a pixel circuit.

The OLED is connected between the pixel circuit and a second driving power line and emits predetermined color light by emitting light in proportion to a data current amount supplied from the pixel circuit.

To this end, the OLED includes an anode electrode (or a pixel electrode) connected to the pixel circuit, a cathode electrode (or a reflection electrode) connected to the second driving power line, and a light emitting cell formed between the anode electrode and the cathode electrode to emit light of one of red, green, blue, and white colors.

The light emitting cell may be formed to have a structure of hole transport layer/organic emission layer/electron transport layer or a structure of hole injection layer/hole transport layer/organic emission layer/electron transport layer/electron injection layer. In addition, the light-emitting cell may further include a functional layer for improving the luminescent efficiency and/or lifespan of the organic emission layer.

The pixel circuit supplies the OLED with a data current corresponding to a data voltage supplied from a data driver to a data line in response to a gate signal of a gate-on voltage level supplied from a gate driver to a gate line.

At this time, the data voltage has a voltage value in which deterioration characteristics of the OLED are compensated. To this end, the pixel circuit includes a switching transistor, a driving transistor, and at least one capacitor, which are formed on a substrate by a thin film transistor forming process. The switching transistor and the driving transistor may be a-Si TFT, poly-Si TFT, oxide TFT, organic TFT, or the like.

The switching transistor may supply a gate electrode of the driving transistor with the data voltage supplied to the data line according to the gate signal of the gate-on voltage level supplied to the gate line.

Since the driving transistor is turned on according to a gate-source voltage including the data voltage supplied from the switching transistor, it is possible to control a current amount flowing from a driving voltage line (PL1) to the OLED.

The memory 170 may store the cooling time of the display panel 150. Although described below, the cooling time may be the time during which the display panel 150 must be turned off for afterimage compensation of the display panel 150.

The processor 190 may control an overall operation of the OLED display apparatus 100.

The processor 190 may include a timing controller. However, this is merely an example, and the timing controller may be present as a separate element from the processor.

The timing controller may control driving timings of the gate driver and the data driver based on a timing synchronization signal input from an external system main body (not shown) or a graphic card (not shown).

The timing controller may generate a gate control signal and a data control signal based on a timing synchronization signal such as a vertical synchronization signal, a horizontal synchronization signal, a data enable signal, a dot clock, or the like.

The timing controller may control the driving timing of the gate driver through the gate control signal, and may control the driving timing of the data driver through the data control signal so as to be synchronized therewith.

The processor 190 may measure the use time of the display panel 150. If the measured use time exceeds a predetermined time, the processor 190 may automatically perform an afterimage compensation algorithm for preventing pixel deterioration of the display panel 150.

In one embodiment, the predetermined time may be 2,000 hours for household use, and 600 hours for a store, but this is merely an example.

The processor 190 performs an operation for compensating for an afterimage generated in the display panel 150 at regular periods, so as to prevent deterioration of pixels constituting the display panel 150.

In order for accurate afterimage compensation, the display panel 150 needs to be sufficiently cooled.

That is, before the afterimage compensation, the display panel 150 needs to secure the cooling time during which the operation must be turned off.

If the supply of AC power to the OLED display apparatus 100 is maintained and the supply of DC power is interrupted, the processor 190 is in an enabled state, and thus, it is possible to measure the cooling time during which the display panel 150 is turned off.

In one embodiment, the processor 190 may use a timer to measure the time during which the display panel 150 has been turned off and determine whether the measured time satisfies the cooling time.

In another embodiment, if the supply of AC power is maintained and the supply of DC power is interrupted, the processor 190 may measure the cooling time of the display panel 150 by using the discharge circuit 130, which will be described below.

Meanwhile, even if the supply of AC power is interrupted, the processor 190 may check the cooling time of the display panel 150 by using the discharge circuit 130.

The processor 190 may measure the cooling time of the display panel 150 by checking the discharge amount of the capacitor which is measured by the discharge circuit 130.

The specific operation of the processor 190 will be described below in more detail.

Figure 2:
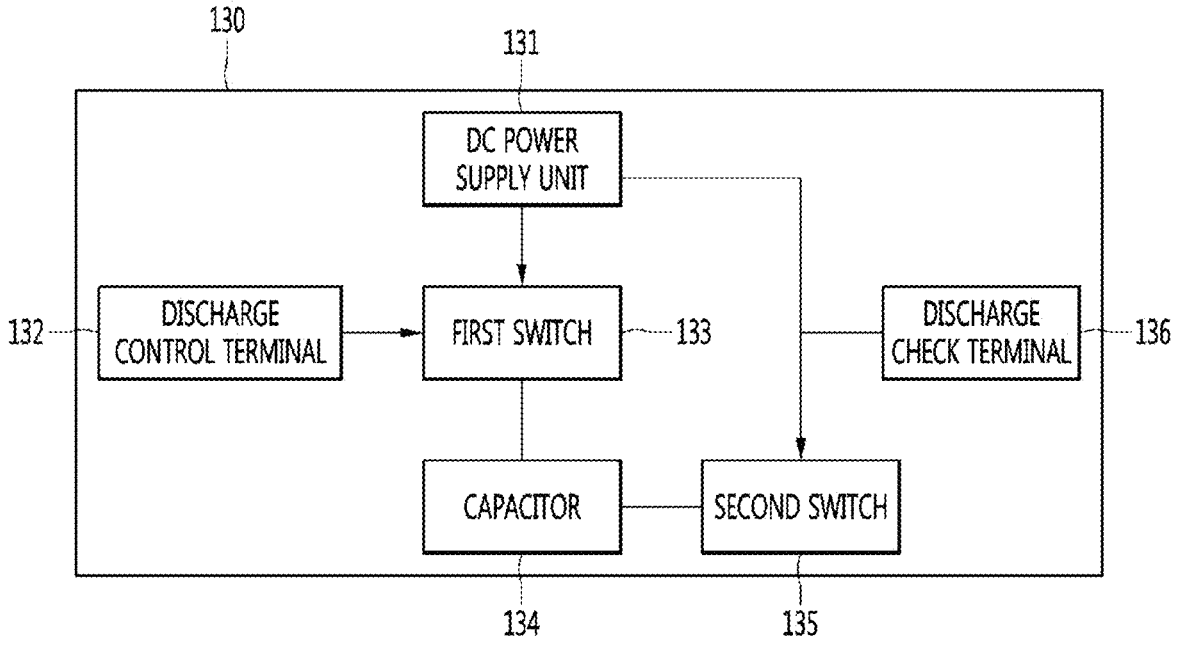
FIG. 2 is a block diagram for describing a configuration of a discharge circuit according to an embodiment of the present disclosure.
Figure 3:
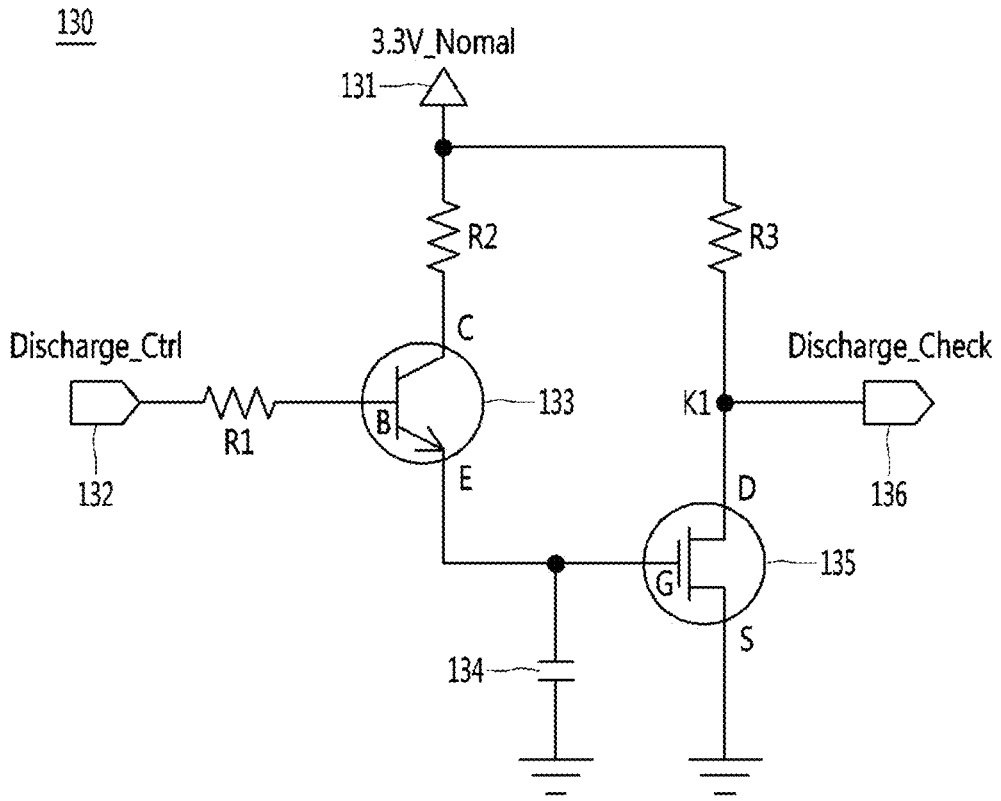
FIG. 3 is a circuit diagram for describing an actual circuit configuration of the discharge circuit according to an embodiment of the present disclosure.

FIG. 2 is a block diagram for describing the configuration of the discharge circuit according to an embodiment of the present disclosure, and FIG. 3 is a circuit diagram for describing the actual circuit configuration of the discharge circuit according to an embodiment of the present disclosure.

The discharge circuit 130 has been described as being present as a separate element from the processor 190, but is not limited thereto. The discharge circuit 130 may be included in the configuration of the processor 190.

The discharge circuit 130 may be included in the processor 190 in the form of System On Chip (SOC), or may be configured separately from the processor 190, which is in the SOC form, and connected to the processor 190.

Referring to FIGS. 2 and 3, the discharge circuit 130 may include a DC power supply unit 131, a discharge control terminal 132, a first switch 133, a capacitor 134, a second switch 135, and a discharge check terminal 136.

In FIGS. 2 and 3, the discharge control terminal 132 and the discharge check terminal 136 are described as being included in the discharge circuit 130, but this is merely an example. The discharge control terminal 132 and the discharge check terminal 136 may be included in the processor 190.

Hereinafter, it is assumed that the case where the supply of power to the display panel 150 is interrupted includes both the case where the supply of AC power to the display panel 150 is interrupted and the case where the supply of DC power to the display panel 150 is interrupted.

The processor 190 may determine whether the cooling time necessary for cooling the display panel 150 is secured, during a period of time during which the supply of power to the display panel 150 through the discharge circuit 130 is turned off (interrupted).

If the power is supplied to the processor 190, the processor 190 may determine whether the display panel 150 has satisfied the cooling time during a period of time during which the supply of power to the display panel 150 is interrupted, based on the signal output from the discharge circuit 130.

The processor 190 determines the cooling time if the power is supplied to the processor 190, because the processor 190 is not enabled if the power is not supplied to the processor 190, and thus, the processor 190 cannot determine whether the display panel 150 has satisfied the cooling time.

The DC power supply unit 131 may supply DC power to the discharge circuit 130. In particular, the DC power supply unit 131 may supply DC power to the first switch 133 or the second switch 135.

The DC power supply unit 131 may include the discharge circuit 130 as shown in FIG. 2, but this is merely an example. The DC power supply unit 131 may be present as a separate element from the discharge circuit 130.

The discharge control terminal 132 may apply, to the first switch 133, a signal capable of determining whether the capacitor 134 is charged or discharged under the control of the processor 190.

The discharge control terminal 132 may be a general port input/output (GPIO) output terminal.

The discharge control terminal 132 may determine whether to apply a high signal for turning on the first switch 133 according to whether the power is supplied to the display panel 150.

If the power is supplied to the display panel 150, the discharge control terminal 132 may apply the high signal for turning on the first switch 133 to the first switch 133.

If the power is not supplied to the display panel 150, the discharge control terminal 132 may not apply the high signal to the first switch 133. That is, if the power is not supplied to the display panel 150, a voltage for driving the first switch 133 is not applied, and thus the first switch 133 may be turned off.

This seems as if a low signal for turning off the first switch 133 is applied to the first switch 133.

The first switch 133 may be a bipolar junction transistor (BJT). The reason why the BJT is used as the first switch 133 is that the use of a field effect transistor (FET) may cause an unintended discharge operation because of parasitic diode components between a source terminal and a drain terminal.

The first switch 133 may be turned on according to the high signal received from the discharge control terminal 132. As the first switch 133 is turned on, a DC voltage transferred from the DC power supply unit 131 may be applied to the capacitor 134.

Accordingly, the capacitor 134 may be charged with voltage.

If the supply of power to the display panel 150 is interrupted, the first switch 133 may be turned off. As the first switch 133 is turned off, the voltage charged in the capacitor 134 may be discharged.

The capacitor 134 may be charged or discharged according to the on or off operation of the first switch 133.

If the supply of power is interrupted, the capacitor 134 may have a capacity to measure the time that is the same as the predetermined cooling time of the display panel 150 or exceeds the cooling time thereof.

In FIGS. 2 and 3, it has been assumed that one capacitor 134 is used, but embodiments of the present disclosure are not limited thereto. The capacitor 134 may be configured by a plurality of capacitors.

The second switch 135 may be turned on according to the discharge of the capacitor 134. That is, the voltage discharged from the capacitor 134 is applied to a gate terminal of the second switch 135, and thus the second switch 135 may be turned on.

While the voltage is charged to the capacitor 134, no voltage is applied to the gate terminal of the second switch 135, and thus the second switch 135 may be turned off.

The second switch 135 may be turned off if the voltage charged in the capacitor 134 is completely discharged.

The discharge check terminal 136 may output a discharge uncompleted signal or a discharge completed signal based on a voltage at a reference point K1 connected to the second switch 135 and the power supply unit 131. The reference point K1 is a reference point for determining whether the voltage of the capacitor 134 has been completely discharged.

Referring to FIG. 3, the reference point K1 may be a point at which one end of the discharge check terminal 136, the drain terminal of the second switch (FET) 135, and one end of a third resistor R3 are met.

The discharge check terminal 136 may detect the on/off state of the second switch 135 based on the measured voltage.

If the voltage measured at the reference point K1 is a first voltage or lower, the discharge check terminal 136 may determine that the second switch 135 is in a turned-on state, and output a discharge-uncompleted signal indicating that the voltage of the capacitor 134 has not been completely discharged. It will be understood throughout that in alternate embodiments, the discharge check terminal may only output a discharge-completed signal when the voltage of the capacitor has been completely discharged, and no discharge-uncompleted signal is output.

The first voltage may be a maximum voltage satisfying an output condition of the discharge-uncompleted signal.

The first voltage may be 0.67 V, but is merely an example.

If the voltage measured at the reference point K1 is a second voltage or higher, the discharge check terminal 136 may determine that the second switch 135 is in a turned-off state, and output a discharge-completed signal indicating that the voltage of the capacitor 134 has been completely discharged.

The second voltage may be a minimum voltage satisfying an output condition of the discharge-completed signal.

The second voltage may be 2.7 V, but is merely an example.

If the second switch 135 is turned on, the discharge check terminal 136 may recognize that the voltage of the capacitor 134 has not been completely discharged, and output a discharge-uncompleted signal. In alternate embodiments, the discharge check terminal may only output a discharge-completed signal when the voltage of the capacitor has been completely discharged, and no discharge-uncompleted signal is output.

In addition, if the second switch 135 is turned off, the discharge check terminal 136 may recognize that the voltage of the capacitor 134 has been completely discharged, and output a discharge-completed signal.

If the discharge-completed signal is output through the discharge check terminal 136, the processor 190 may determine that the cooling time of the display panel 150 is satisfied.

If the cooling time is satisfied, the processor 190 may perform an afterimage compensation algorithm. To this end, the processor 190 may include an afterimage compensation circuit.

The afterimage compensation circuit may be a circuit for compensating for the deterioration of the pixels of the display panel 150.

The afterimage compensation circuit may include a current sensor for measuring a current flowing through the OLED constituting the pixel.

The afterimage compensation circuit may detect the deterioration degree of the pixel by using a difference between an existing current value and a changed current value with respect to the same voltage.

The afterimage compensation circuit may acquire a current amount, of which a current value is reduced with respect to an existing current value. The afterimage compensation circuit may compensate for the deterioration of the pixel by applying the reduced current amount to the OLED.

The cooling time necessary for the afterimage compensation of the display panel 150 may be 55 minutes, but this is merely an example. The cooling time may be changed according to the size of the display panel 150 and the model of the display panel 150.

The reason why the cooling time of a predetermined time is secured before the afterimage compensation is that, if the afterimage compensation is performed in a state in which the display panel 150 is not sufficiently cooled, the temperature of the display panel 150 is high and an excessive voltage is sensed, and thus the afterimage compensation is not accurately performed.

If the discharge-uncompleted signal is output through the discharge check terminal 136, or if the discharge-completed signal has not yet been output, the processor 190 may determine that the cooling time of the display panel 150 is not satisfied. In this case, if AC power is supplied, the processor 190 may output a notification indicating that the cooling time is not satisfied through the display panel 150.

Then, the processor 190 may perform an operation for securing the cooling time of the display panel 150. The operation for securing the cooling time of the display panel 150 may be an operation of turning off a screen of the display panel 150.

If the cooling time of the display panel 150 is secured, the processor 190 may perform the afterimage compensation algorithm.

Next, the actual circuit configuration of the discharge circuit 130 according to an embodiment of the present disclosure will be described with reference to FIG. 3.

One end of the discharge control terminal 132 is connected to one end of a first resistor R1. The other end of the discharge control terminal 132 is connected to the processor 190.

The other end of the first resistor R1 is connected to a base terminal B of a first switch (BJT) 133.

A collector terminal C of the first switch 133 is connected to one end of a second resistor R2.

An emitter terminal E of the first switch 133 is connected to one end of a capacitor 134.

One end of the capacitor 134 is connected to a gate terminal of the second switch (FET) 135.

The other end of the capacitor 134 is grounded.

A source terminal S of the second switch 135 is grounded, and a drain terminal D of the second switch 135 is connected to one end of the discharge check terminal 136 and one end of a third resistor R3.

The other end of the discharge check terminal 136 is connected to the processor 190.

The other end of the third resistor R3 is connected to the other end of the second resistor R2 and the DC power supply unit 131

The reference point K1 may be a point at which one end of the discharge check terminal 136, the drain terminal of the second switch (FET) 135, and one end of the third resistor R3 are met.

Figure 4:
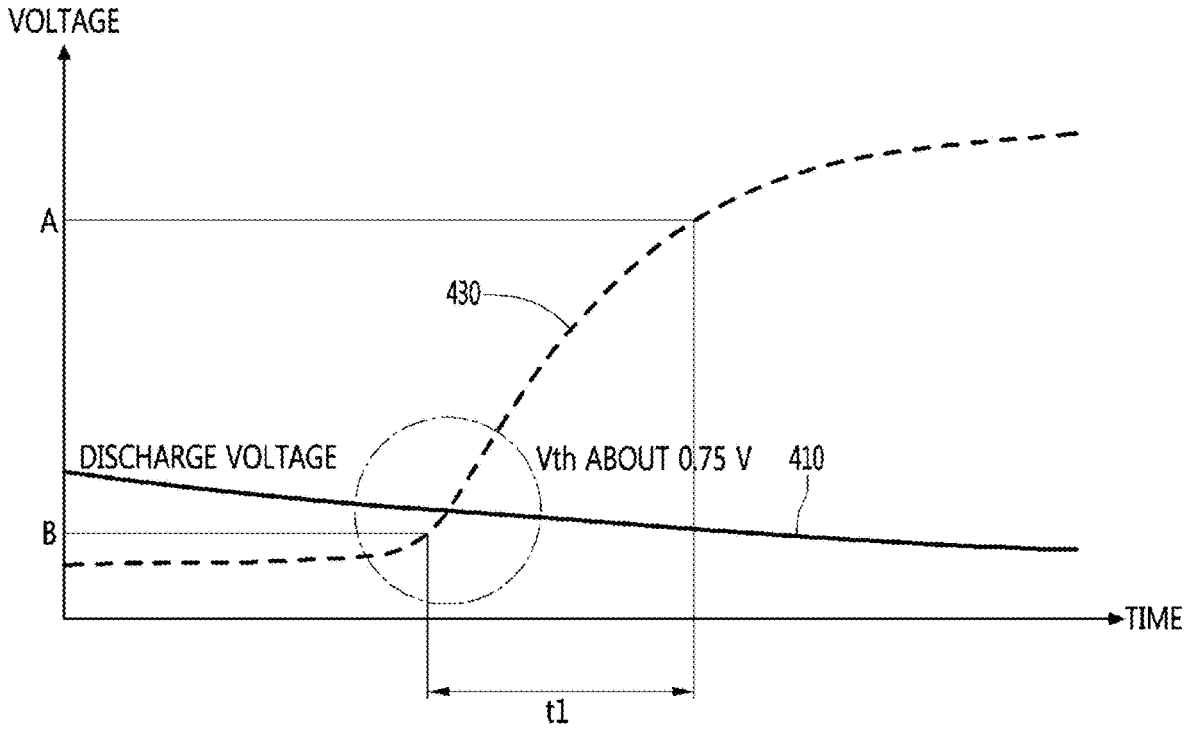
FIG. 4 is a graph showing a change in an output voltage of a second switch according to a voltage discharge of a capacitor, according to an embodiment of the present disclosure.

FIG. 4 is a graph showing a change in the output voltage of the second switch according to the voltage discharge of the capacitor, according to an embodiment of the present disclosure.

Hereinafter, the description of FIG. 4 is given based on the description provided with reference to FIGS. 2 and 3.

In the graph of FIG. 4, a horizontal axis represents a time and a vertical axis represents a voltage value.

A first waveform 410 is a waveform showing a change in a voltage discharged from the capacitor 134. That is, the first waveform 410 is a waveform showing a change in a voltage across the capacitor 134.

A second waveform 430 is a waveform showing a change in a voltage output from the reference point K1 of FIG. 3.

As can be seen from the first waveform 410, as the voltage charged in the capacitor 134 is discharged, the voltage across the capacitor 134 is reduced.

Accordingly, the discharged voltage is applied to the gate terminal G of the second switch 135, and thus the voltage measured at the reference point K1 may increase (see the second waveform).

As a result, the voltage measured at the reference point K1 may be a voltage that increases as the capacitor 134 is discharged.

If the voltage measured at the reference point K1 is a second voltage A, the processor 190 may determine that the cooling time of the display panel 150 is satisfied.

That is, if the voltage measured at the reference point K1 is the second voltage A, the discharge check terminal 136 may determine that the second switch 135 is turned off, and output the discharge-completed signal.

More specifically, if the voltage measured at the reference point K1 is the second voltage A or higher, the discharge check terminal 136 may determine that the second switch 135 is turned off, and output the discharge-completed signal.

The processor 190 may determine that the cooling time of the display panel 150 is satisfied through the discharge-completed signal.

The processor 190 may drive the afterimage compensation algorithm according to the discharge-completed signal output from the discharge check terminal 136.

In one embodiment, if the voltage measured at the reference point K1 is the first voltage B or lower, the discharge check terminal 136 may determine that the second switch 135 is turned on, and output the discharge-uncompleted signal. In alternate embodiments, the discharge check terminal may only output a discharge-completed signal when the voltage of the capacitor has been completely discharged, and no discharge-uncompleted signal is output.

If the discharge-uncompleted signal is detected, or if no discharge-completed signal has been detected, the processor 190 may determine that the cooling time of the display panel 150 is not satisfied, and turn off the screen so as to satisfy the cooling time of the display panel 150.

Then, if the cooling time of the display panel 150 is secured, the processor 190 may drive the afterimage compensation circuit.

Next, the process of performing the afterimage compensation algorithm according to whether the cooling time of the display panel 150 is satisfied will be described with reference to the flowchart.

Figure 5:
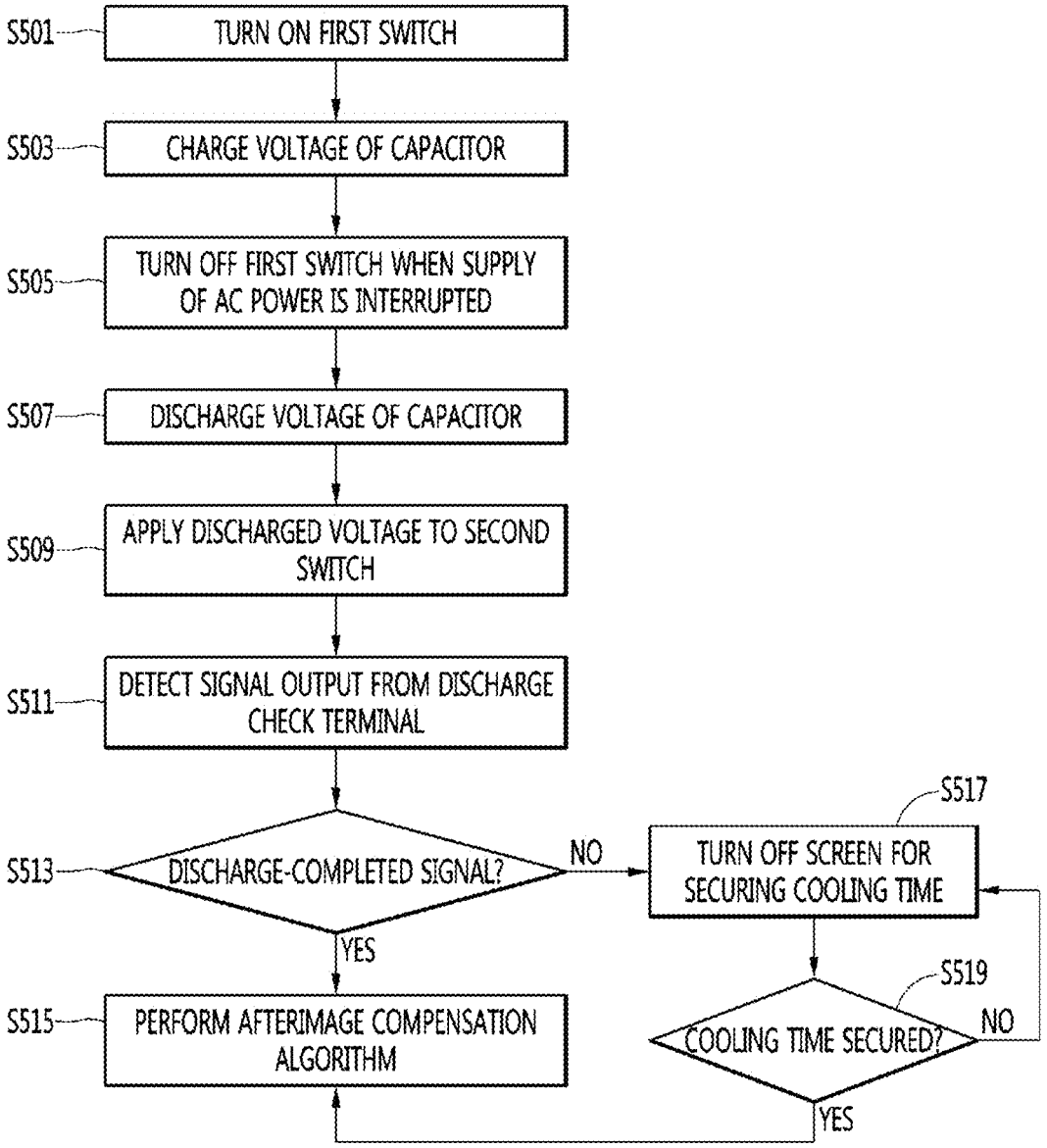
FIG. 5 is a flowchart of a method of operating an OLED display apparatus, according to an embodiment of the present disclosure.

FIG. 5 is a flowchart of a method of operating the OLED display apparatus, according to an embodiment of the present disclosure.

Hereinafter, the method of operating the OLED display apparatus will be described with reference to FIGS. 1 to 4.

First, if AC power is supplied to the display panel 150, the processor 190 turns on the first switch 133 (S501), and the voltage transferred from the DC power supply unit 131 is charged to the capacitor 134 as the first switch 133 is turned on (S503).

Then, if the supply of AC power is interrupted, the first switch 133 is also turned off (S505).

Accordingly, the voltage charged in the capacitor 134 is discharged (S507).

The discharge voltage of the capacitor 134 is applied to the second switch 135 (S509). If the supply of AC power is supplied, the processor 190 detects a signal output from the discharge check terminal 136 (S511).

The processor 190 may determine whether the signal output from the discharge check terminal 136 is a discharge-completed signal (S513).

If the discharge check terminal 136 outputs the discharge-completed signal, the processor 190 may perform the afterimage compensation algorithm (S515). That is, the discharge-completed signal may be a trigger signal for driving the afterimage compensation algorithm to the display panel 150.

If the discharge check terminal 136 outputs the discharge-uncompleted signal, or in other embodiment if the discharge completed signal has not yet been output, the processor 190 turns off the screen of the display panel 150 so as to secure the cooling time of the display panel 150 (S517).

That is, the discharge-uncompleted signal, or in other embodiments the lack of discharge-completed signal, may be a signal for securing the cooling time of the display panel 150.

In one embodiment, the processor 190 may output a notification indicating that the operation for securing the cooling time of the display panel 150 is being performed.

If the cooling time of the display panel 150 is secured (S519), the processor 190 may perform the afterimage compensation algorithm (S515).

Next, a configuration of a discharge circuit according to another embodiment of the present disclosure will be described.

Figure 6:
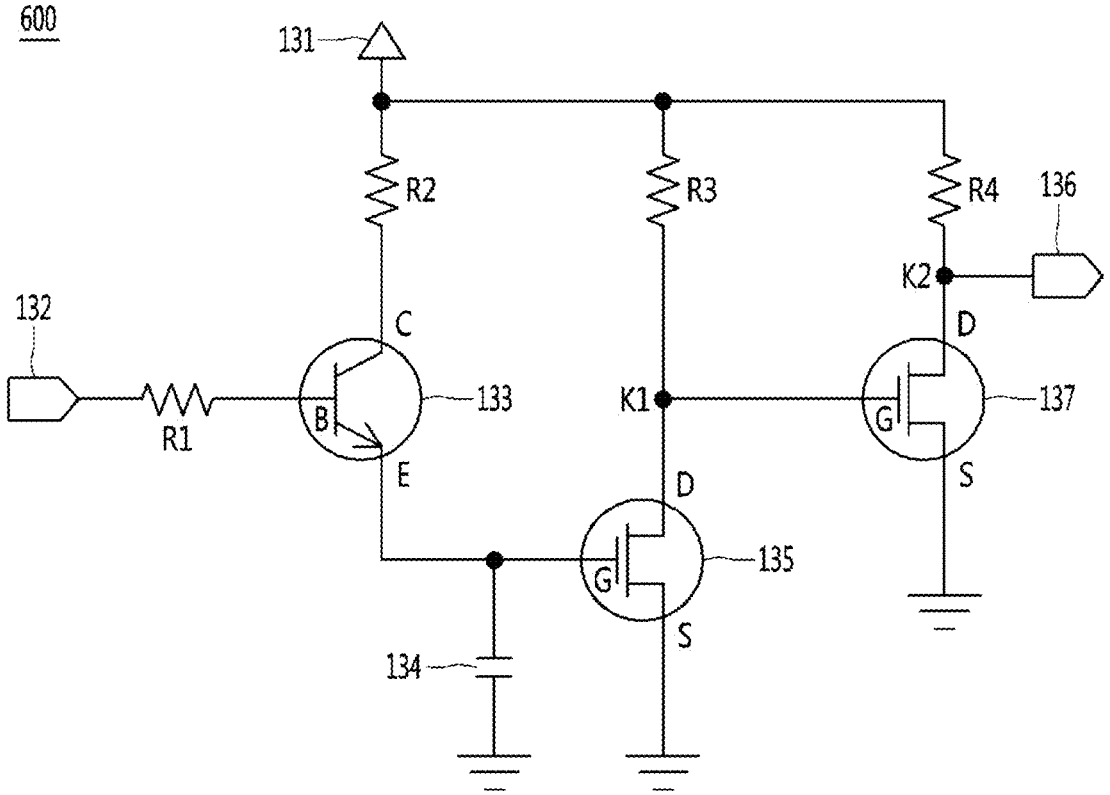
FIGS. 6 and 7 are circuit diagrams for describing a configuration of a discharge circuit according to another embodiment of the present disclosure.
Figure 7:
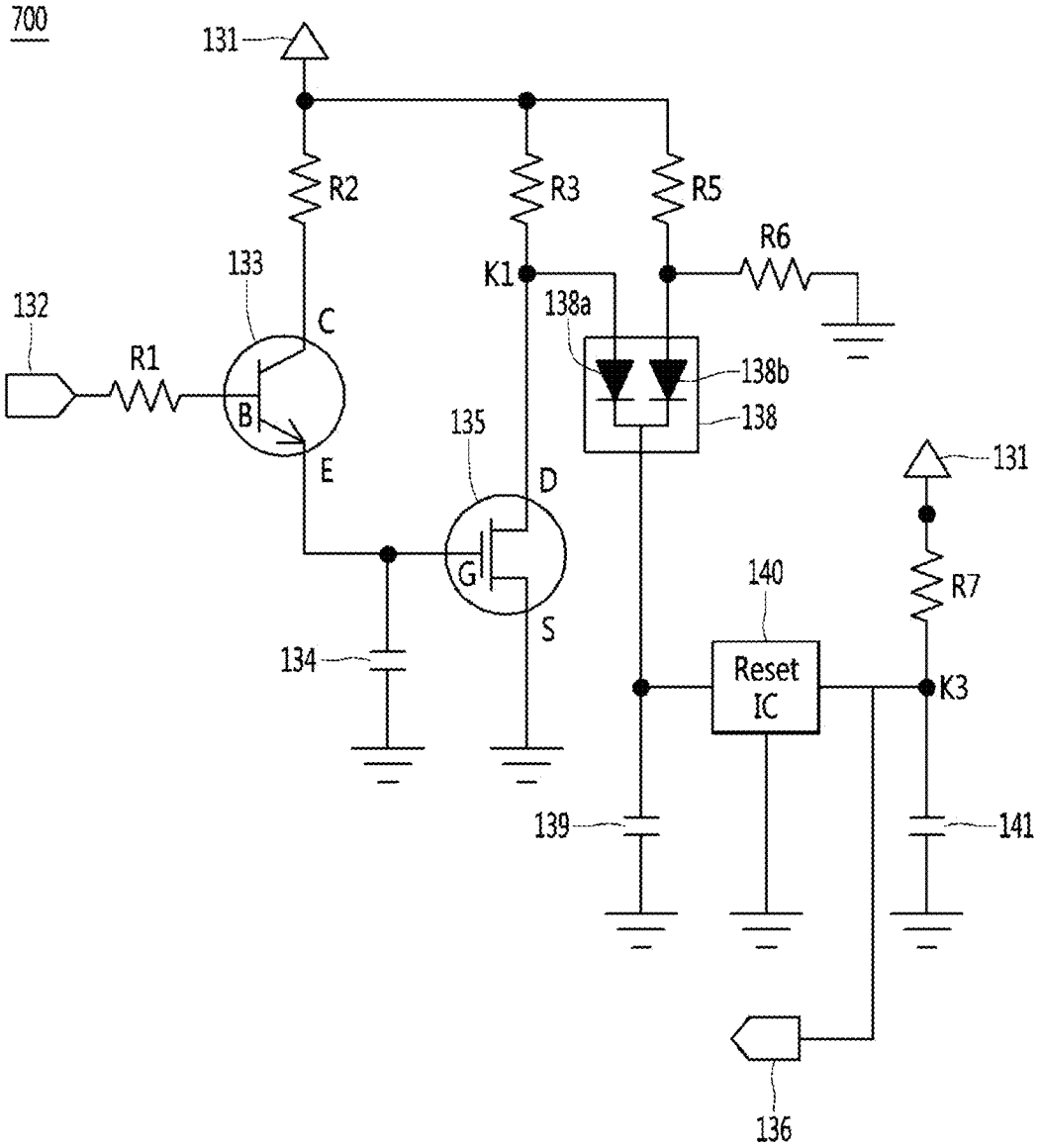

FIGS. 6 and 7 are circuit diagrams for describing a configuration of a discharge circuit according to another embodiment of the present disclosure.

In particular, FIG. 6 is a circuit diagram of a discharge circuit 600 for reducing an unknown period of the voltage measured at the reference point K1 described with reference to FIG. 4, and FIG. 7 is a circuit diagram of a discharge circuit 700 for removing an unknown period of the voltage measured at the reference point K1.

Referring to FIG. 6, the discharge circuit 600 may include a DC power supply unit 131, a discharge control terminal 132, a first switch 133, a capacitor 134, a second switch 135, a third switch 137, and a discharge check terminal 136.

The DC power supply unit 131, the discharge control terminal 132, the first switch 133, the capacitor 134, and the second switch 135 are substantially the same as those of FIGS. 2 and 3.

The discharge circuit 600 of FIG. 6 may further include the third switch 137, in addition to the discharge circuit 130 of FIGS. 2 and 3.

The third switch 137 may be a FET.

A gate terminal G of the third switch 137 is connected to a drain terminal of the second switch 135 and one end of the third resistor R3.

A source terminal S of the third switch 137 is grounded

A drain terminal D of the third switch 137 is connected to one of the discharge check terminal 136 and one end of a fourth resistor R4. The other end of the fourth resistor R4 is connected to one end of a third resistor R3.

A reference point K2 may be a point at which one end of the fourth resistor R4, one end of the discharge check terminal 136, and the drain terminal of the third switch 137 are met.

The third switch 137 may be a switch used for reducing an unknown period.

This will be described below with reference to FIG. 4.

Referring to FIG. 4, if the voltage measured at the reference point K1 is a second voltage A or higher, the processor 190 may read the discharge-completed (or high) signal of the discharge check terminal 136 and check that the cooling time of the display panel 150 is satisfied.

In addition, if the voltage measured at the reference point K1 is the first voltage B or lower, the processor 190 may read the discharge-uncompleted (or low) signal of the discharge check terminal 136.

That is, the processor 190 may recognize only a case where the voltage measured at the reference point K1 is the first voltage B or lower and a case where the voltage measured at the reference point K1 is the second voltage A or higher. In other words, the processor 190 cannot check the voltage of the reference point K1 which exceeds the first voltage B and is lower than the second voltage A.

Since the discharge check terminal 136 cannot check the voltage that is lower than the second voltage A and exceeds the first voltage B, the period between the first voltage B and the second voltage A may be referred to as an unknown period t1.

If the unknown period t1 is long, the time for determining the cooling time of the display panel 150 may not be accurately grasped. Due to this, the afterimage compensation operation of the display panel 150 may not be smoothly performed.

If the unknown period t1 can be reduced, whether the cooling time is satisfied may be more accurately grasped.

The discharge circuit 600 of FIG. 6 is capable of reducing the unknown period through the third switch 137.

The third switch 137 may invert the voltage at the reference point K1 and output the inverted voltage.

The waveform of the voltage at the reference point K2 will be described with reference to FIG. 8.

Figure 8:
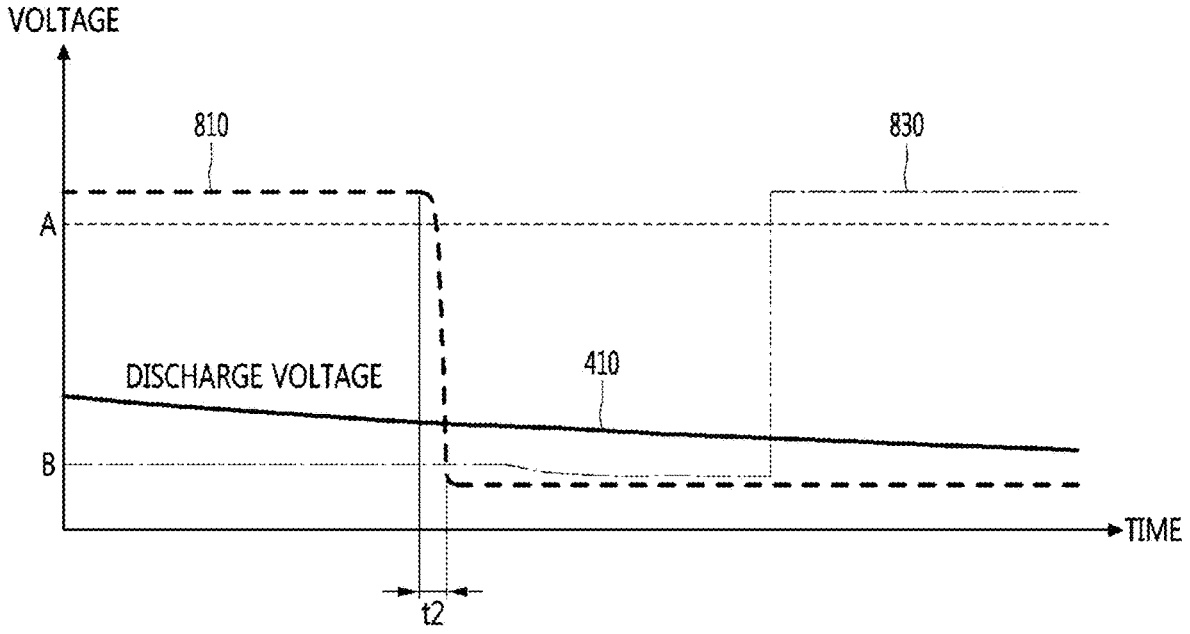
FIG. 8 is a diagram for describing a waveform of an output voltage of a discharge circuit according to a discharge of a capacitor, according to an embodiment of the present disclosure.

FIG. 8 is a diagram for describing a waveform of an output voltage of a discharge circuit according to a discharge of a capacitor, according to an embodiment of the present disclosure.

Referring to FIG. 8, a first waveform 410 is a waveform showing a change in a voltage discharged from the capacitor 134. That is, the first waveform 410 is a waveform showing a change in a voltage across the capacitor 134.

A third waveform 810 is a waveform showing a change in the voltage measured at the reference point K2 of FIG. 6.

Referring to FIG. 8, the voltage measured at the reference point K2 is inverted while passing through the third switch 137.

In this case, if the voltage measured at the reference point K2 is the first voltage B or lower, the discharge check terminal 136 may detect the discharge-completed signal.

If the voltage measured at the reference point K2 exceeds the second voltage A, the discharge check terminal 136 may detect the discharge-uncompleted signal.

In addition, if a FET is used as the third switch 137, the time to reach the first voltage B from the second voltage A may be reduced through a high speed switching operation.

The unknown period in which the voltage measured at the reference point K2 reaches the first voltage B from the second voltage A is remarkably reduced by t2, as compared with the unknown period t1.

Next, FIG. 7 is described.

In particular, a circuit of FIG. 7 may be a discharge circuit 700 for removing an unknown period.

Referring to FIG. 7, the discharge circuit 700 may include a DC power supply unit 131, a discharge control terminal 132, a first switch 133, a capacitor 134, a second switch 135, a diode pair 138, a first capacitor 139, a reset IC circuit 140, a second capacitor 141, and a discharge check terminal 136.

The DC power supply unit 131, the discharge control terminal 132, the first switch 133, the capacitor 134, and the second switch 135 are substantially the same as those of FIGS. 2 and 3.

The diode pair 138 may include a first diode 138*a* and a second diode 138*b*.

One end of the first diode 138*a* is connected to one end of a third resistor R3 and a drain terminal of the second switch 135. One end of the first diode 138*a* is connected to one end of the first capacitor 139 and one end of the reset IC circuit 140.

One end of the second diode 138*b* is connected to one end of a fifth resistor R5 and one end of a sixth resistor R6. The other end of the second diode 138*b* is connected to one end of the first capacitor 139 and one end of the reset IC circuit 140.

The other end of the fifth resistor R5 is connected to the other end of the third resistor R3, and the other end of the sixth resistor R6 is grounded.

The other end of the first capacitor 139 is grounded.

The other end of the reset IC circuit 140 is connected to one end of the discharge check terminal 136, one end of the second capacitor 141, and one end of a seventh resistor R7. The other end of the second capacitor 141 is grounded.

The other end of the seventh resistor R7 is connected to the DC power supply unit 131.

The diode pair 138 serves to satisfy a minimum voltage for driving the reset IC circuit 140.

The first capacitor 139 may remove a noise from a voltage output by the diode pair 138.

The second capacitor 141 may remove a noise from a voltage output from the reset IC circuit 140.

If the voltage measured at the reference point K3 exceeds a predetermined voltage, the reset IC circuit 140 may output the discharge-completed signal to the discharge check terminal 136.

The reference point K3 may be a point at which the other end of the reset IC circuit 140, one end of the discharge check terminal 136, one end of the second capacitor 141, and one end of the seventh resistor R7 are met.

If the voltage measured at the reference point K3 is lower than the predetermined voltage, the reset IC circuit 140 may output the discharge-uncompleted signal to the discharge check terminal 136. In alternate embodiments, the reset IC circuit may only output a discharge-completed signal when the voltage of the capacitor has been completely discharged, and no discharge-uncompleted signal is output.

That is, the reset IC circuit 140 may output the discharge-completed signal if the voltage measured at the reference point K3 exceeds the predetermined voltage, and in some embodiments may output the discharge-uncompleted signal if the voltage measured at the reference point K3 is lower than the predetermined voltage.

If the voltage measured at the reference point K3 is equal to the predetermined voltage, the reset IC circuit 140 may output the discharge-completed signal or in some embodiments the discharge-uncompleted signal.

That is, even if the voltage measured at the reference point K3 is equal to the predetermined voltage, the reset IC circuit 140 may output the discharge-completed signal or in some embodiments the discharge-uncompleted signal so as to prevent the occurrence of the unknown period.

Referring to FIG. 8, a fourth waveform 830 shows a waveform of the voltage measured at the reference point K3 if the reset IC circuit 140 is included in the discharge circuit 700.

It can be seen from the fourth waveform 830 that no unknown period is present in the process of changing the first voltage B to the second voltage A. This is because, due to the presence of the reset IC circuit 140, it is designed to output only the discharge-completed signal or in some embodiments the discharge-uncompleted signal.

In the case of using the reset IC circuit 140, the unknown period is not present, and thus the cooling time of the display panel 140 may be more accurately measured. Therefore, the afterimage compensation of the display panel 140 may be stably performed.

Next, a method of operating an OLED display apparatus, according to another embodiment of the present disclosure, will be described with reference to FIG. 9.

Figure 9:
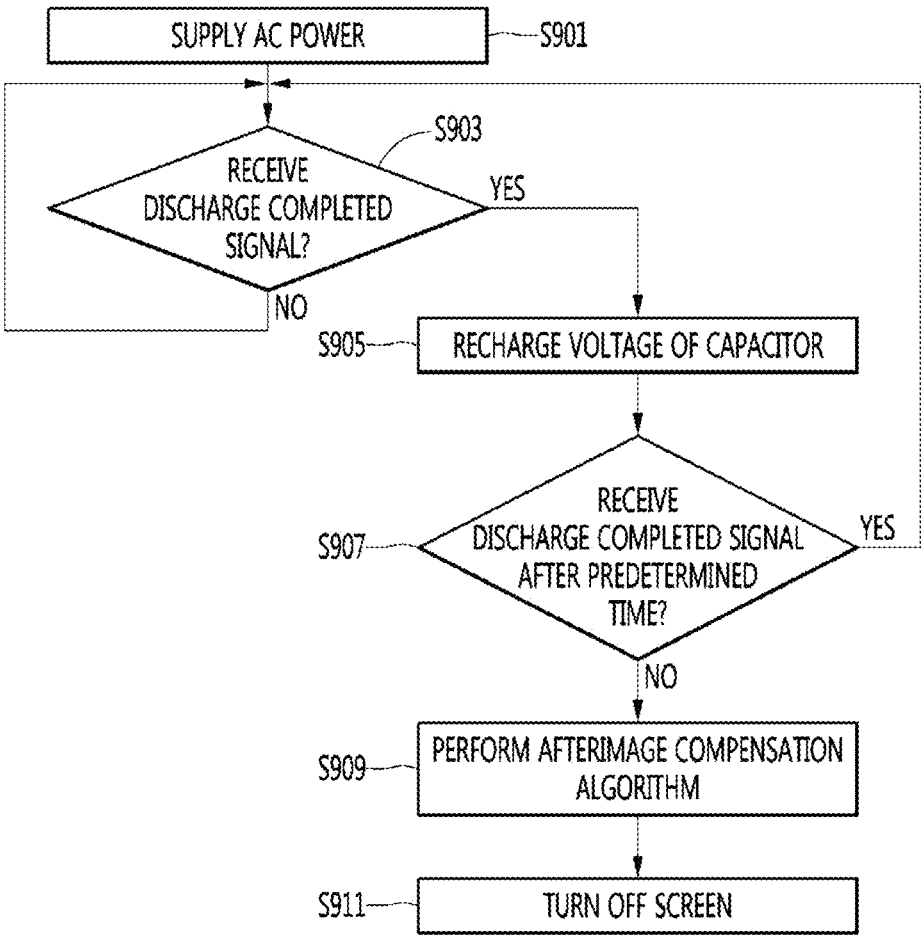
FIG. 9 is a flowchart of a method of operating an OLED display apparatus, according to another embodiment of the present disclosure.

In particular, FIG. 9 is a flowchart of a method of preventing the afterimage compensation algorithm from being driven, even though the cooling time of the display panel 150 is not satisfied, in a case where the FET or the capacitor is burnt or cracked.

The embodiment of FIG. 9 is described on the assumption of the discharge circuit 700 described with reference to FIG. 7, but is a scenario that is applicable to both of FIGS. 3 and 6.

The power supply unit 110 supplies AC power to the display panel 150 (S901).

The processor 190 determines whether the discharge completed signal has been received (S903).

In one embodiment, if the discharge-completed signal is output through the discharge check terminal 136, the processor 190 may determine that the voltage discharge of the capacitor 134 has been completed.

In one embodiment, if the discharge-uncompleted signal is output through the discharge check terminal 136, or in some embodiments if the discharge completed signal has not yet been output, the processor 190 may determine that the voltage discharge of the capacitor 134 has not been completed.

If it is determined that the voltage discharge of the capacitor 134 has been completed, the processor 190 recharges the voltage of the capacitor (S905), and determines whether the discharge completed signal has been received (S907).

If it is determined that the discharge completed signal has been received, the processor 190 determines that the discharge circuit 700 malfunctions, and performs step 903 again, without performing the afterimage compensation algorithm (S907).

That is, if the voltage of the capacitor 134 is recharged, the discharge check terminal 136 must not output the discharge-completed signal.

If the discharge-completed signal is detected through the discharge check terminal 136, the processor 190 may determine that the discharge circuit 700 malfunctions and do not perform the afterimage compensation of the display panel 150.

If it is determined that the voltage discharge of the capacitor has not been completed, the processor 190 performs the afterimage compensation algorithm (S909).

The processor 190 may perform operations S905 to S909 more than a predetermined number of times. This is done for securing the reliability of the operation of the discharge circuit.

The processor 190 turns off the screen of the display panel 150 during the execution of the afterimage compensation algorithm (S911).

After the afterimage compensation algorithm has been completed, the processor 190 may turn on the screen of the display panel 150.

Figure 10:
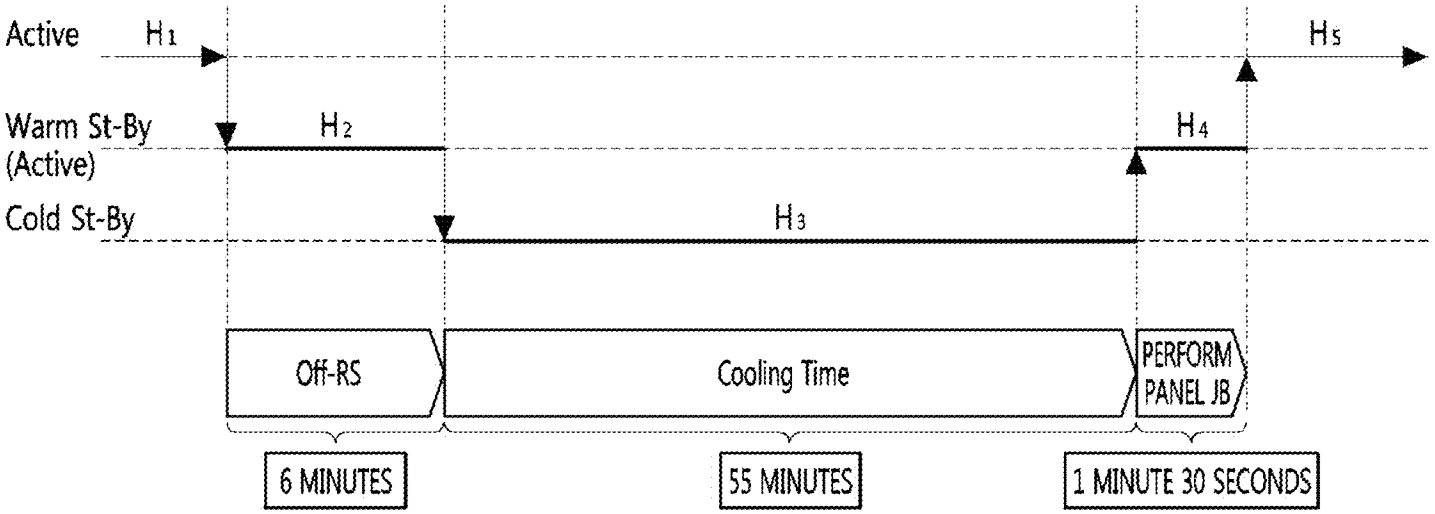
FIG. 10 is a graph for describing a process of performing afterimage compensation of a display panel, according to an embodiment of the present disclosure.

FIG. 10 is a graph for describing the process of performing the afterimage compensation of the display panel, according to an embodiment of the present disclosure.

The sequence for compensating for the afterimage of the display panel 150 is shown in FIG. 10.

It is assumed in FIG. 10 that the use time necessary for the afterimage compensation of the display panel 150 is satisfied.

The graph of FIG. 10 is divided into a plurality of periods. The plurality of periods may include a pre-compensation activation period H1, an Off-RS compensation period H2, a cooling time period H3, an afterimage compensation period H4, and a post-compensation activation period H5.

The pre-compensation activation period H1 and the post-compensation activation period H5 may be periods in which AC power is supplied to the display panel 150 and thus the image is driven on the display panel 150.

The Off-RS compensation period H2 may be a period in which the compensation for the voltage of the display panel 150 is performed without regard to the temperature of the display panel 150 (that is, the cooling time is not needed).

The Off-RS compensation period H2 may be a period of a standby state in which AC power is supplied, but DC power is not supplied.

The cooling time period H3 may be a period that turns off the screen of the display panel 150 before the afterimage compensation.

The afterimage compensation period H4 is a period that compensates for the deterioration of pixels constituting the display panel 150 after the cooling time period H3.

If the afterimage compensation is performed in a state in which the cooling time of the display panel 150 is not satisfied, a pixel deterioration compensation rate may be reduced.

This will be described with reference to the accompanying drawings.

Figure 11A:
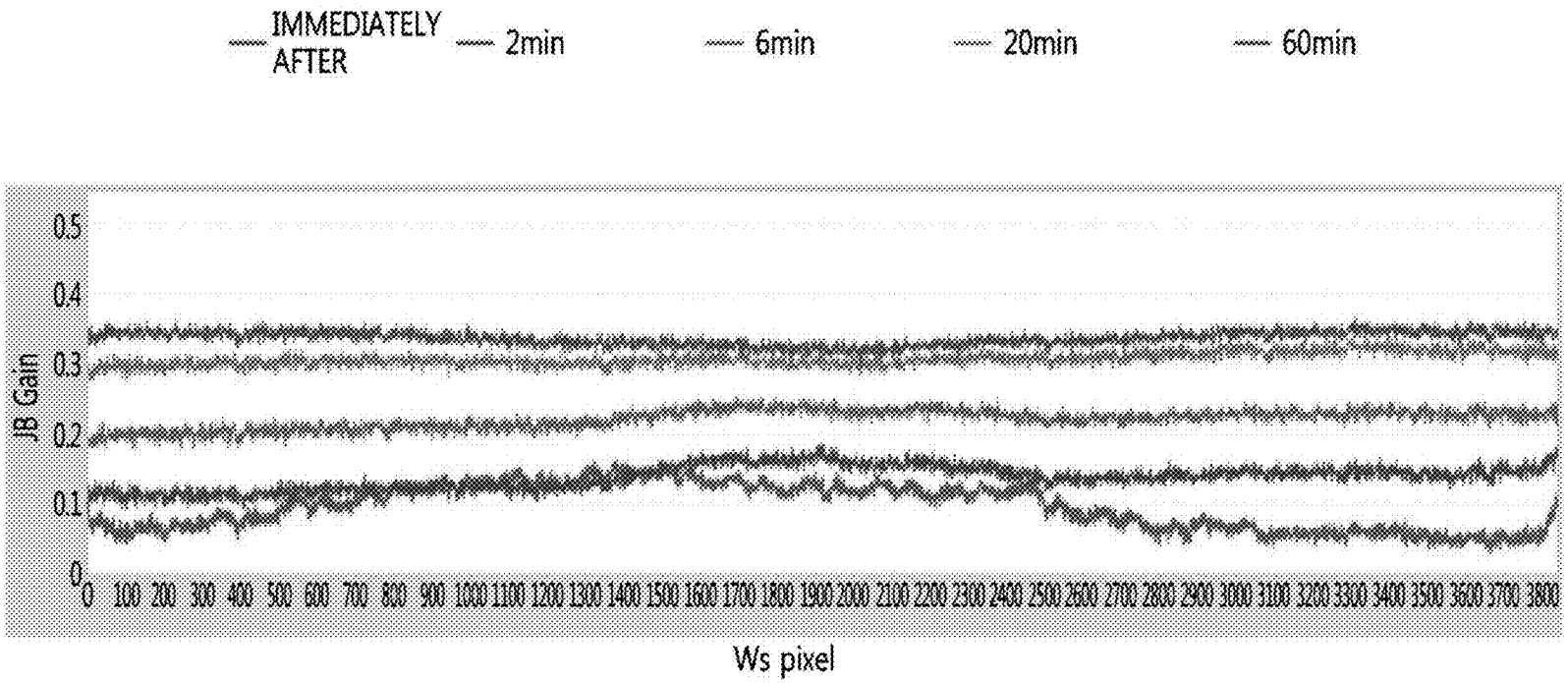
FIGS. 11A to 12 show test results for describing problems that may occur if afterimage compensation is performed if a cooling time of a display panel is not satisfied.
Figure 11B:
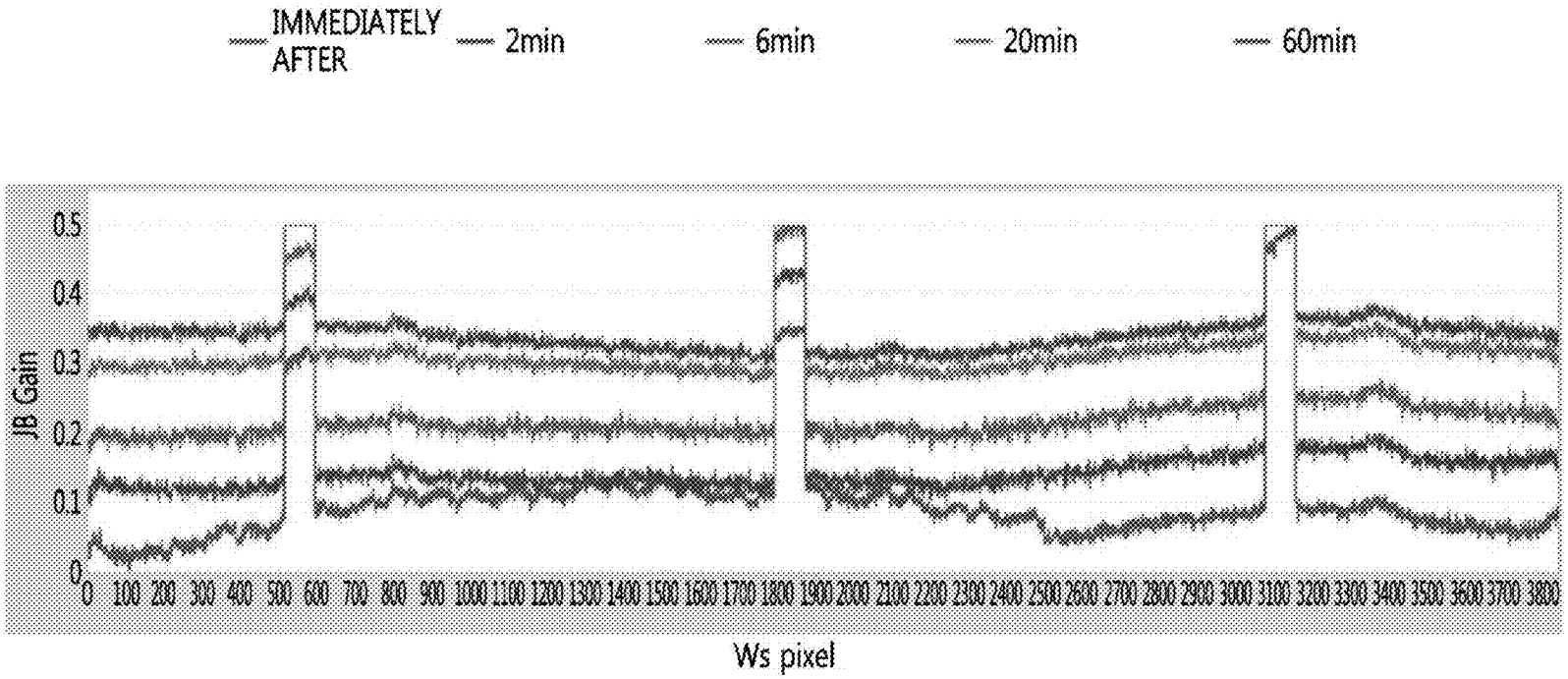
Figure 11C:
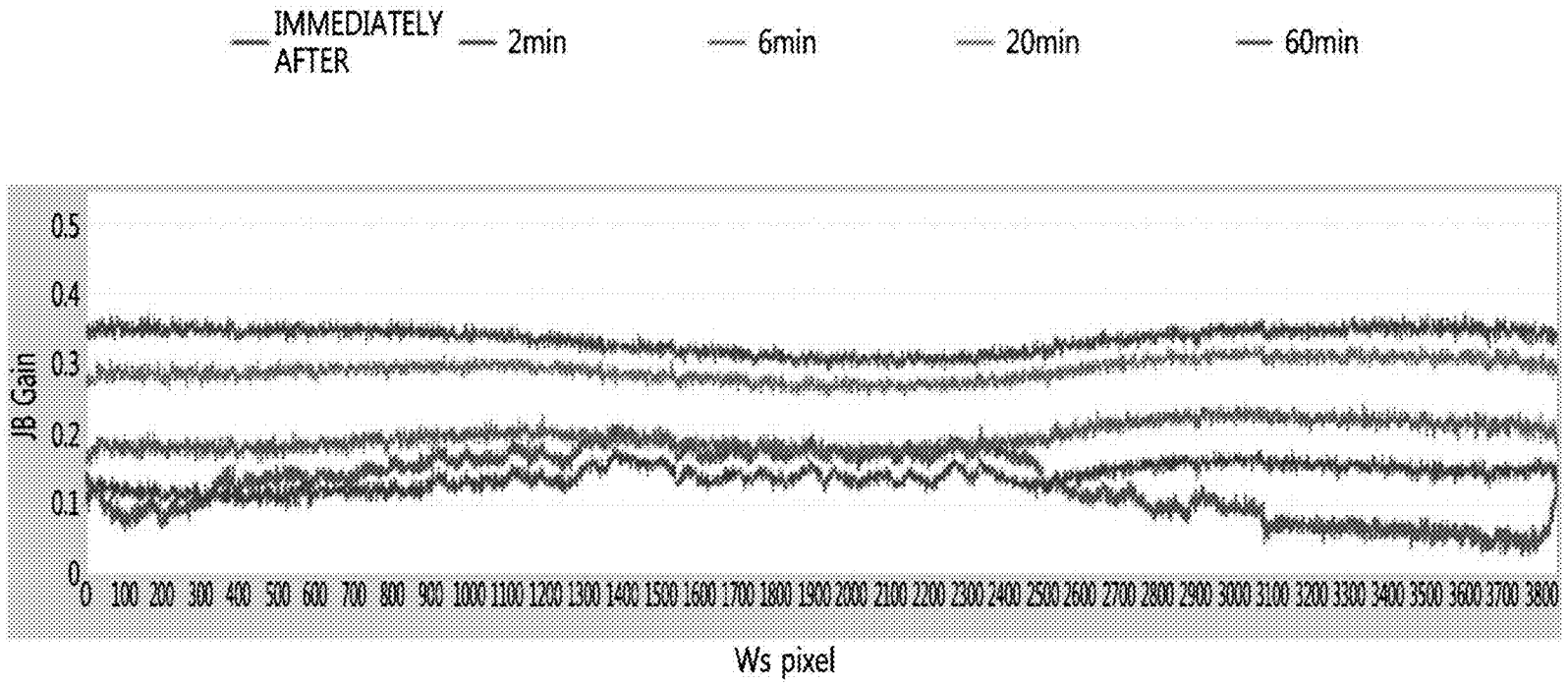
Figure 11D:
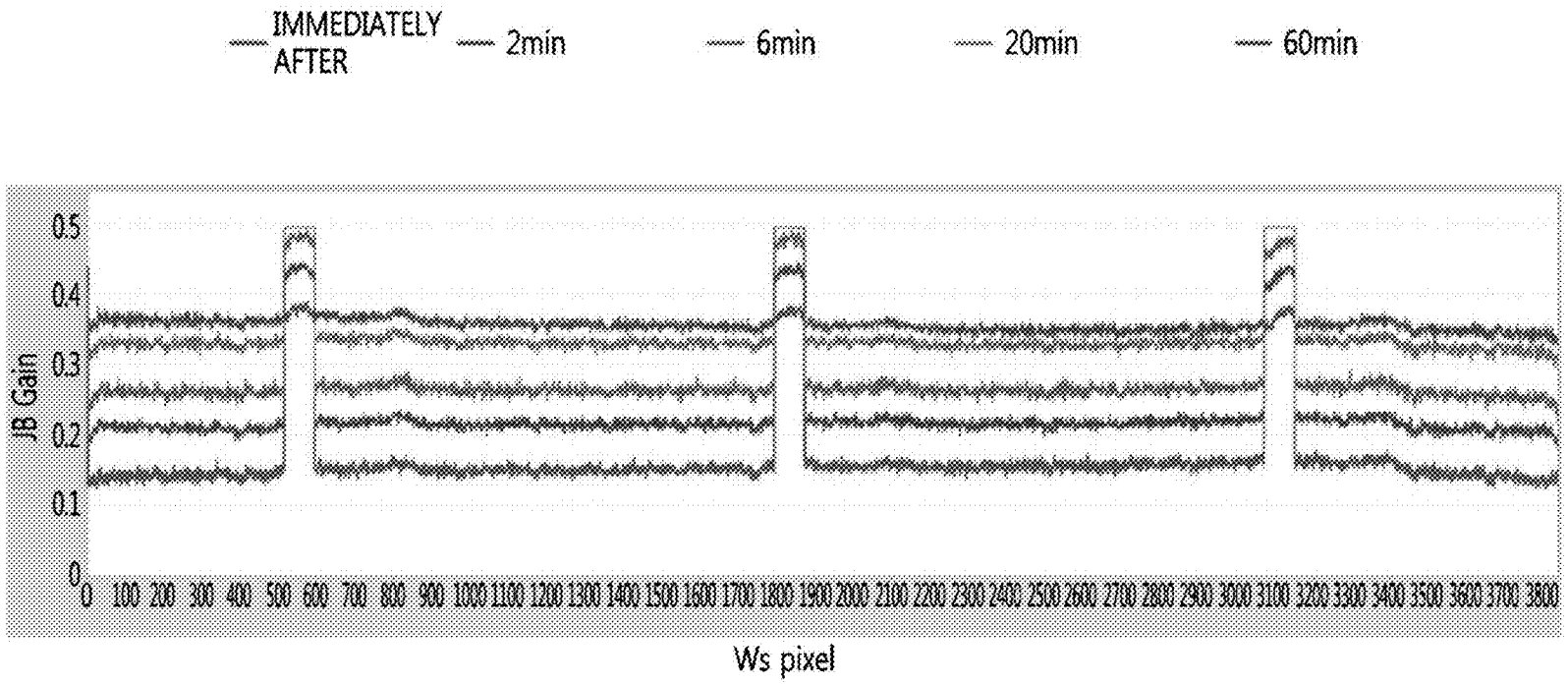
Figure 11E:
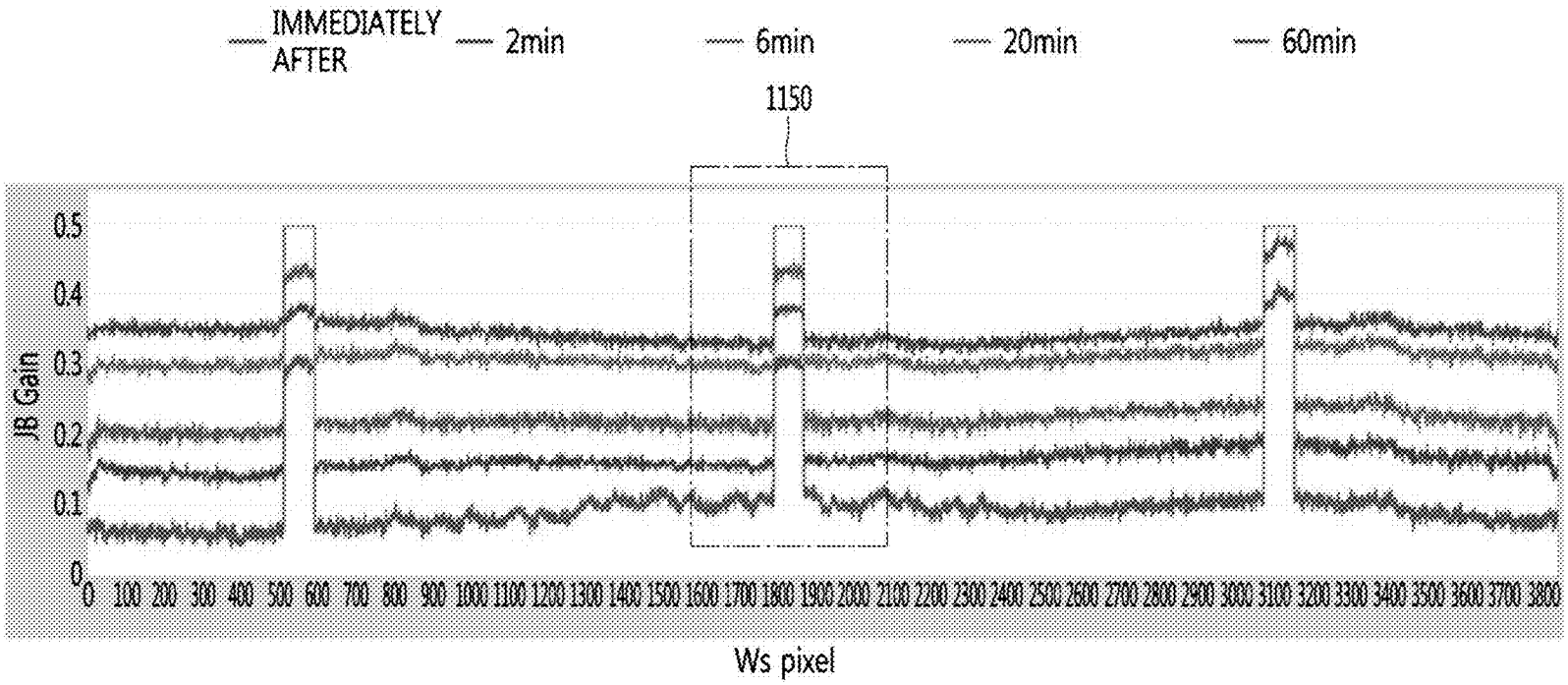
Figure 11F:
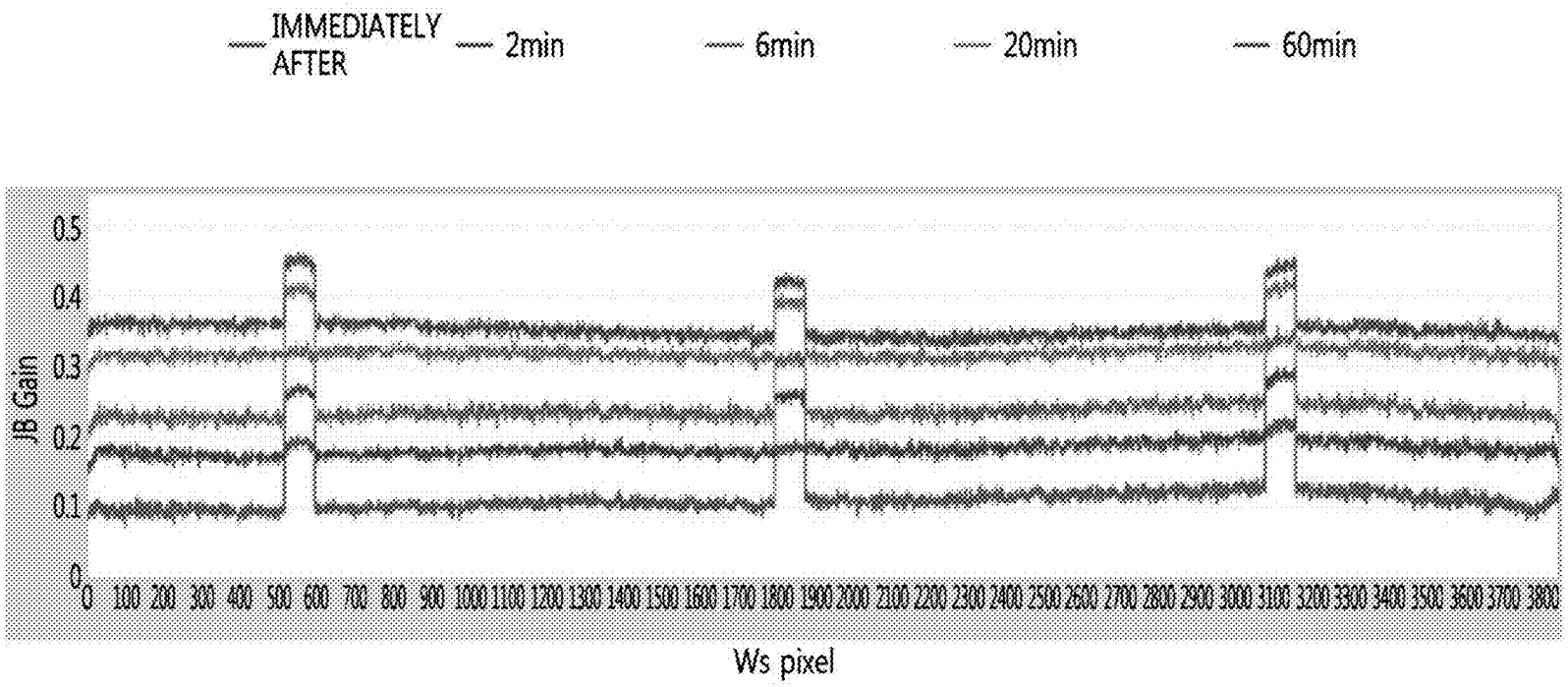
Figure 12:
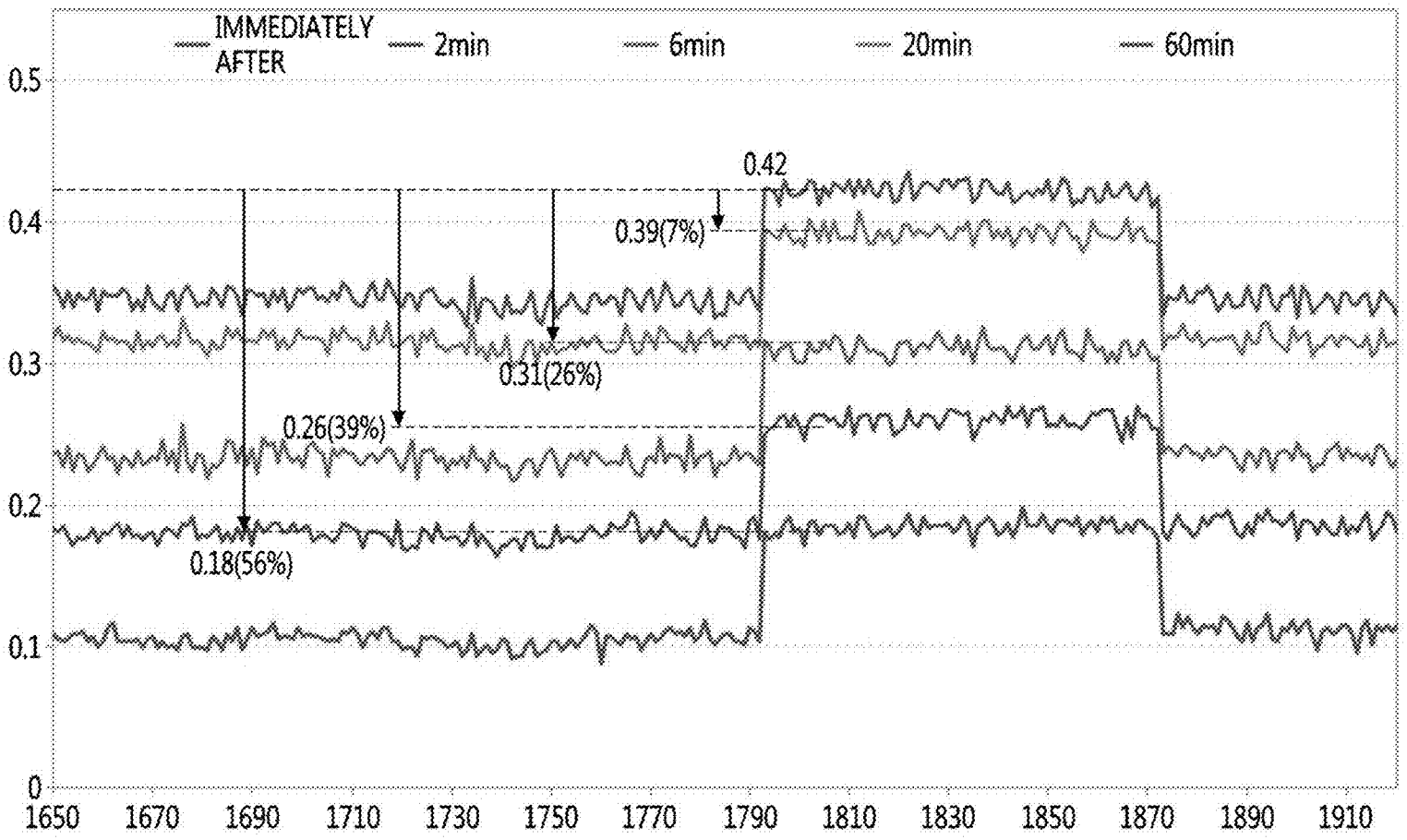

FIGS. 11*a* to 12 show test results for describing problems that may occur if the afterimage compensation is performed if the cooling time of the display panel is not satisfied.

In particular, FIGS. 11*a* to 12 show a change in a gain value of afterimage compensation according to a change in the cooling time of the display panel 150, after the image driving is finished, if an ambient temperature of the display panel 150 is 25° C.

In order to properly perform the afterimage compensation of the display panel 150, the gain value must maintain a predetermined value or more.

FIGS. 11*a* to 11*f* show a change in an afterimage gain value according to a pixel with respect to each of a plurality of image scanning lines.

Each test was performed in a case where the afterimage compensation was performed immediately after the display panel 150 finished the image driving, in a case where the afterimage compensation was performed after 2 minutes, in a case where the afterimage compensation was performed after 6 minutes, in a case where the afterimage compensation was performed after 20 minutes, and in a case where the afterimage compensation was performed after 60 minutes. It is assumed that the cooling time of the display panel 150 necessary for the afterimage compensation is 60 minutes.

In this case, it is assumed that the waveform on which the afterimage compensation is performed satisfies the cooling time after 60 minutes from the finish of the image driving.

FIG. 11*a* is a waveform diagram showing a change in an afterimage compensation value according to a pixel, which was measured at a 2100th image scanning line.

FIG. 11*b* is a waveform diagram showing a change in an afterimage compensation value according to a pixel, which was measured at a 1950th image scanning line.

FIG. 11*c* is a waveform diagram showing a change in an afterimage compensation value according to a pixel, which was measured at a 1580th image scanning line.

FIG. 11*d* is a waveform diagram showing a change in an afterimage compensation value according to a pixel, which was measured at a 1220th image scanning line.

FIG. 11*e* is a waveform diagram showing a change in an afterimage compensation value according to a pixel, which was measured at a 1000th image scanning line.

FIG. 11*f* is a waveform diagram showing a change in an afterimage compensation value according to a pixel, which was measured at a 500th image scanning line.

Referring to FIGS. 11*a* to 11*f*, it is confirmed that the gain value of the afterimage compensation is rapidly reduced so that the afterimage compensation is rapidly performed immediately after the image driving is finished. That is, if the cooling time is short as compared with the cooling time of the display panel 150, the afterimage compensation gain value becomes small, thus causing the problem that reduces the compensation rate of the pixel.

Referring to FIGS. 11*a* and 11*c*, immediately after the image driving (it is assumed to be 1 second), it can be seen from the waveform of performing the afterimage compensation that the afterimage compensation gain value is erroneously measured. This is caused by local heat generation. If the afterimage compensation gain value is erroneously measured, it is highly likely that the afterimage compensation is inaccurately performed.

FIG. 12 is an enlarged view of a portion 1150 of the graph of FIG. 11*e*.

Referring to FIG. 12, first to fifth gain waveforms 1201 to 1209 are shown on the 1000th image scanning line.

The first gain waveform 1201 is a waveform showing a change in the afterimage compensation gain value according to a pixel, if the afterimage compensation is performed, immediately after the image driving (after 1 second) on the display panel 150.

The second gain waveform 1203 is a waveform showing a change in the afterimage compensation gain value according to a pixel, if the afterimage compensation is performed, after 2 minutes from the finish of the image driving on the display panel 150.

The third gain waveform 1205 is a waveform showing a change in the afterimage compensation gain value according to a pixel, if the afterimage compensation is performed, after 6 minutes from the finish of the image driving on the display panel 150.

The fourth gain waveform 1207 is a waveform showing a change in the afterimage compensation gain value according to a pixel, if the afterimage compensation is performed, after 20 minutes from the finish of the image driving on the display panel 150.

The fifth gain waveform 1209 is a waveform showing a change in the afterimage compensation gain value according to a pixel, if the afterimage compensation is performed, after 60 minutes from the finish of the image driving on the display panel 150.

In the first to fifth gain waveforms 1201 to 1209, the afterimage compensation gain values corresponding to the 1790th pixel are compared.

The afterimage compensation gain value is 0.42 in the case of the fifth gain waveform 1209, 0.39 in the case of the fourth gain waveform 1207, 0.31 the case of the third gain waveform 1205, 0.26 the case of the second gain waveform 1203, and 0.18 the case of the first gain waveform 1201.

As the cooling time is shorter as compared with the cooling time of 60 minutes, the afterimage compensation gain value is reduced.

As the afterimage compensation gain value is reduced, it is highly likely that the timing controller will inaccurately recognize the deterioration of the pixel, thus causing the problem that reduces the compensation rate.

According to an embodiment, the above-described method may also be embodied as processor-readable codes on a program-recorded medium. Examples of the processor-readable medium may include a ROM, a RAM, a CD-ROM, a magnetic tape, a floppy disk, and an optical data storage device.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display apparatus comprising:

a display panel;

a discharge circuit configured to discharge a voltage of a capacitor included in the discharge circuit when a supply of power to the display panel is interrupted after the display panel is driven for more than a predetermined time and to output a signal based on the discharged voltage of the capacitor;

an afterimage compensation circuit configured to perform afterimage compensation by applying a reduced amount of a current flowing through a pixel constituting the display panel; and a processor configured to:

determine whether a cooling time that the display panel is turned off for cooling the display panel before performing afterimage compensation of the display panel is satisfied based on the signal output from the discharge circuit, wherein the cooling time corresponds to a reference time for determining whether to perform the afterimage compensation, and perform the afterimage compensation of the display panel using the afterimage compensation circuit based on a determination that the cooling time has been satisfied.

2. The organic light emitting diode display apparatus according to claim 1, wherein the discharge circuit further comprises:

a first switch configured to be turned on or off according to whether the power is supplied to the display panel; and a second switch configured to be turned on or off according to whether the capacitor is charged or discharged, and the processor is further configured to determine whether the cooling time is satisfied according to a state of the second switch.

3. The organic light emitting diode display apparatus according to claim 2, wherein the discharge circuit further comprises:

a discharge control terminal configured to apply a high signal for turning on the first switch according to whether the power is supplied to the display panel; and a discharge check terminal configured to output a discharge-completed signal based on a voltage measured at a first reference point.

4. The organic light emitting diode display apparatus according to claim 3, wherein the discharge check terminal is further configured to output the discharge-completed signal when voltage at the first reference point is a second voltage or higher and the second switch is turned off, wherein the discharge-completed signal is not output while the second switch is turned on and the voltage at the first reference point is a first voltage or lower.

5. The organic light emitting diode display apparatus according to claim 4, wherein the processor is configured to perform the afterimage compensation if output of the discharge-completed signal is detected from the discharge check terminal.

6. The organic light emitting diode display apparatus according to claim 5, wherein, if the discharge-completed signal is not detected, the processor is configured to output a notification indicating that the cooling time of the display panel is not satisfied.

7. The organic light emitting diode display apparatus according to claim 6, wherein the processor is further configured to perform the afterimage compensation if the cooling time is satisfied.

8. The organic light emitting diode display apparatus according to claim 4, further comprising a third switch configured to invert the voltage at the first reference point and output an inverted voltage at a second reference point as the voltage at the first reference point increases from the first voltage to the second voltage.

9. The organic light emitting diode display apparatus according to claim 8, wherein the third switch is a field effect transistor.

10. The organic light emitting diode display apparatus according to claim 4, wherein the discharge circuit further comprises a reset IC circuit disposed between the second switch and the discharge check terminal and configured to output the discharge-completed signal if a predetermined voltage or more is input to the reset IC circuit.

11. The organic light emitting diode display apparatus according to claim 3, wherein the processor is further configured to:

recharge a voltage of the capacitor if the discharge-completed signal is detected as a first occurrence; and detect a malfunction and prevent the afterimage compensation if the discharge-completed signal is redetected within a predefined period of time of the first occurrence.

12. The organic light emitting diode display apparatus according to claim 3, wherein the discharge control terminal is a general port input/output (GPIO) output terminal, and the discharge check terminal is a GPIO input terminal.

13. The organic light emitting diode display apparatus according to claim 2, wherein the first switch is a bipolar junction transistor, and the second switch is a field effect transistor.

* * * * *